US009380896B2

(12) United States Patent
Carangelo

(10) Patent No.: US 9,380,896 B2
(45) Date of Patent: Jul. 5, 2016

(54) NATURAL CURVE BABY PILLOW AND GARMENT FOR PREVENTING FLAT HEAD SYNDROME

(76) Inventor: Juliana Carangelo, East Brunswick, NJ (US)

( * ) Notice: Subject to any disclaimer, the term of this patent is extended or adjusted under 35 U.S.C. 154(b) by 1681 days.

(21) Appl. No.: 12/287,489

(22) Filed: Oct. 10, 2008

(65) Prior Publication Data

US 2009/0249526 A1 Oct. 8, 2009

Related U.S. Application Data

(60) Provisional application No. 61/072,876, filed on Apr. 3, 2008.

(51) Int. Cl.
*A47G 9/00* (2006.01)
*A47G 9/10* (2006.01)

(52) U.S. Cl.
CPC ..... *A47G 9/1045* (2013.01)

(58) Field of Classification Search
CPC ..... A47G 9/1045
USPC ..... 2/69.5, 75, 83, 243.1, 49.1, 111, 80, 89; 5/655, 490, 640, 645, 633, 632, 652, 5/639, 643, 636, 657, 653, 656; 128/846, 128/869
See application file for complete search history.

(56) References Cited

U.S. PATENT DOCUMENTS 4,617,691 A * 10/1986 Monti et al. ..... 5/640
5,046,204 A * 9/1991 Mohler ..... 5/413 R
5,131,096 A * 7/1992 Olson ..... 2/75
5,226,193 A * 7/1993 Chen ..... 2/69.5
5,524,640 A * 6/1996 Lisak et al. ..... 5/655
5,815,833 A * 10/1998 Kuo ..... 2/69.5
6,052,850 A * 4/2000 Salido et al. ..... 5/644
6,088,855 A * 7/2000 Connolly ..... 5/636
6,321,403 B1 * 11/2001 Matthews ..... 5/655
6,408,439 B1 * 6/2002 Garforth-Crippen ..... 2/80
6,499,165 B1 * 12/2002 Morgillo ..... 5/655
6,868,566 B2 * 3/2005 Gatten ..... 5/494
6,892,406 B2 * 5/2005 Littlehorn ..... 5/639
7,624,461 B2 * 12/2009 Tidwell et al. ..... 5/655
2005/0125902 A1 * 6/2005 Matthews Brown et al. ..... 5/655
2005/0210592 A1 * 9/2005 Littlehorn et al. ..... 5/655
2006/0026766 A1 * 2/2006 Brewin et al. ..... 5/655
2006/0207029 A1 * 9/2006 Bell ..... 5/655
2007/0044199 A1 * 3/2007 Ebert ..... 2/111
2007/0056109 A1 * 3/2007 Forshpan ..... 5/655

* cited by examiner

*Primary Examiner* — Khaled Annis
(74) *Attorney, Agent, or Firm* — Charles Brodsky

(57) ABSTRACT

Aiding to prevent Flat Head Syndrome, a concave pillow is sewn to the collar of a garment to be worn by an infant or small child, with the pillow having a small circle sewn near its center, slightly closer to one of the sides in creating a support area for the infant's neck and allowing the back of its head to rest on the concave center of the pillow. As the pillow is sewn to the collar of the garment, it will always remain towards the back of the infant, even if the infant should roll over. Such arrangement will prevent the pillow from covering or obstructing the infant's airway—in additionally helping to reduce the risk of Sudden Infant Death Syndrome or the risk of suffocation.

10 Claims, 5 Drawing Sheets

NATURAL CURVE BABY PILLOW AND GARMENT FOR PREVENTING FLAT HEAD SYNDROME

CROSS-REFERENCE TO RELATED APPLICATIONS

A Provisional Patent Application covering the invention described herein was filed Apr. 3, 2008, and assigned Ser. No. 61/072,876.

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

Not Applicable

BACKGROUND OF THE INVENTION

1. Field of the Invention

This invention relates to an infant and small children concave pillow sewn to a security garment that prevents the pillow from covering or obstructing the infant's airways, aiding in the prevention of Flat Head Syndrome or Positional Plagiocephaly and in helping reduce risk of SIDS-Sudden Infant Death Syndrome.

2. Description of the Related Art

It is currently recommended by the "Back to Sleep" Campaign to place infants on their back to sleep, as such measurement is believed to highly reduce the risk of SIDS-Sudden Infant Death Syndrome. The United States "Back to Sleep" Campaign was launched in June 1994 by the U.S. Public Health Service, American Academy of Pediatrics, SIDS Alliance, and Association of SIDS and Infant Mortality Programs, with endorsements by over 60 organizations. Since the Campaign has been introduced, the number of cases of SIDS has been reduced by approximately 50%. But, while the "Back to Sleep" Campaign has gained its place in the United States and other foreign countries, it has caused a rapid 50% increase of Flat Head Syndrome cases as a result of only placing babies on their back to sleep. Positional Plagiocephaly or Flat Head Syndrome develops because the skull of an infant is very soft and susceptible to remolding due to external pressures, such as a flat mattress on the infant's crib.

The "Back to Sleep" Campaign does not recommend the use of any loose crib blankets or loose pillows near infants. The use of loose crib blankets and/or loose pillows is believed to be one of the factors that increase the risk of Sudden Infant Death Syndrome. This follows since loose blankets or loose pillows can potentially cover or obstruct the infant's airway resulting in re-inhaling exhaled carbon dioxide and/or suffocation.

While there has been progress towards reducing the risk of SIDS, there are no efficient, practical and safer measures or products available to promote the infant's natural shape of the head and reduce the number of Flat Head Syndrome cases. Positional Plagiocephaly is only properly prevented or corrected in the early months of one's life, while the skull of the infant is still susceptible to external pressures. When such condition is left untreated, it can cause one's head to have deformed and asymmetrical shape.

OBJECTS OF THE INVENTION

It is an object of the present invention, therefore, to provide a new concave pillow arrangement for infants and small children, which aids in preventing Flat Head Syndrome and helps reduce the risk of suffocation or Sudden Infant Death Syndrome.

It is another object of the invention to provide a pillow arrangement of this type at a reasonable cost to allow for increased aid in the prevention of Flat Head Syndrome.

It is a further object of the invention to provide a pillow arrangement of this type which can be manufactured by using natural and/or environment friendly materials.

SUMMARY OF THE INVENTION

As will become clear, in its broadest aspect, the invention consists of a concave baby pillow arrangement which is sewn to the collar of a security garment to be worn by infants or small children. The pillow's main function is to aid in prevention of flattening of the head in infants—also known as Positional Plagiocephaly—since the pillow's shape resembles the natural curve of a baby's head. What makes this baby pillow a breakthrough is the fact that it is sewn to a security garment. Because the pillow and garment are sewn together, the pillow will remain towards the back of the infant, even if the infant rolled on its side or stomach, eliminating the risk of it ever covering or obstructing the infant's airway.

In this aspect of the invention, the concave pillow can be sewn to a vest having a front opening. The pillow and vest will attach near the neck area of the pillow and the back of the collar on the vest. Alternatively, the pillow can be sewn to a full size wearable blanket. There, the neck area of the pillow will attach to the collar of the wearable blanket.

In a second aspect of the invention, the pillow and its garment can be sewn directly onto a swaddle blanket. The swaddle blanket will help keep the infant on its back. In a third aspect of the invention, side positioners can be added as stabilizers, to aid in keeping the child on its back and restraining against rollover.

Different types of fabrics can be used for this invention, including different types of fabric patterns and colors. Some examples of fabrics can be cotton, terry, fleece, velour, breathable mesh fabrics, natural and organic fabrics, and/or fire retardant fabrics.

Decorative changes can also be added to this invention. One example can be adding little fabric ears to the top of the pillow, or making the product resemble animals, objects, or any other decoration theme.

BRIEF DESCRIPTION OF THE DRAWINGS

These and other features of the invention will be more clearly understood from a consideration of the following description, taken in connection with the accompanying drawings in which.

DETAILED DESCRIPTION OF THE INVENTION

Figure 1:
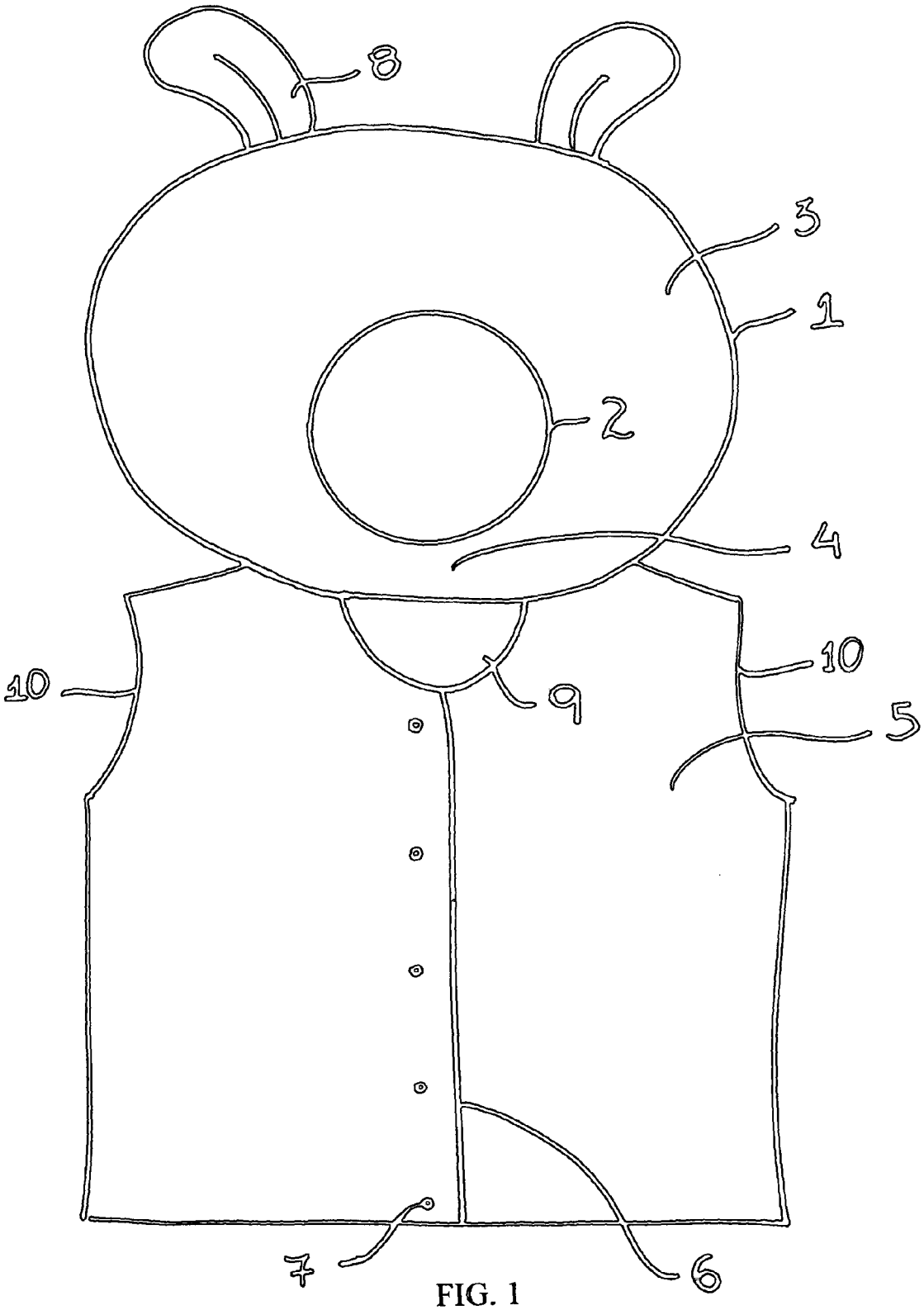
FIG. 1 would be helpful in an understanding of the invention in which the concave pillow is sewn to a vest.

In FIG. 1, the pillow of the invention (1) is shown as being round or oval shape, with a small circle (2) sewn near its center, slightly closer to one of the sides. The circular area (2) is devoid of "fill" with reference numeral (3) representing the all around filled area of the pillow (1). Locating the sewn circle (2) closer to one of the sides of the pillow allows for this one side to have less volume once the pillow becomes filled—thereby making this one thinner side appropriate and comfortable to support the infant's neck. Such thinner side of the pillow constitutes its neck area, shown by the reference numeral (4). The area (3) surrounding the sewn circle (2) is filled so as to create a concave pillow.

Such pillow (1) is sewn to a vest (5) having a front opening (6) along with snaps (7) for closure of the outfit, Decorative ears are indicated by the reference numeral (8). The opening at the center-top of the vest represents a hole (9) through which the infant's neck and head extend. The two smaller holes (10) on each upper side of the garment represent the areas through which the infant's arms extend. The top and underside surfaces of the pillow and vest will be understood.

Figure 2:
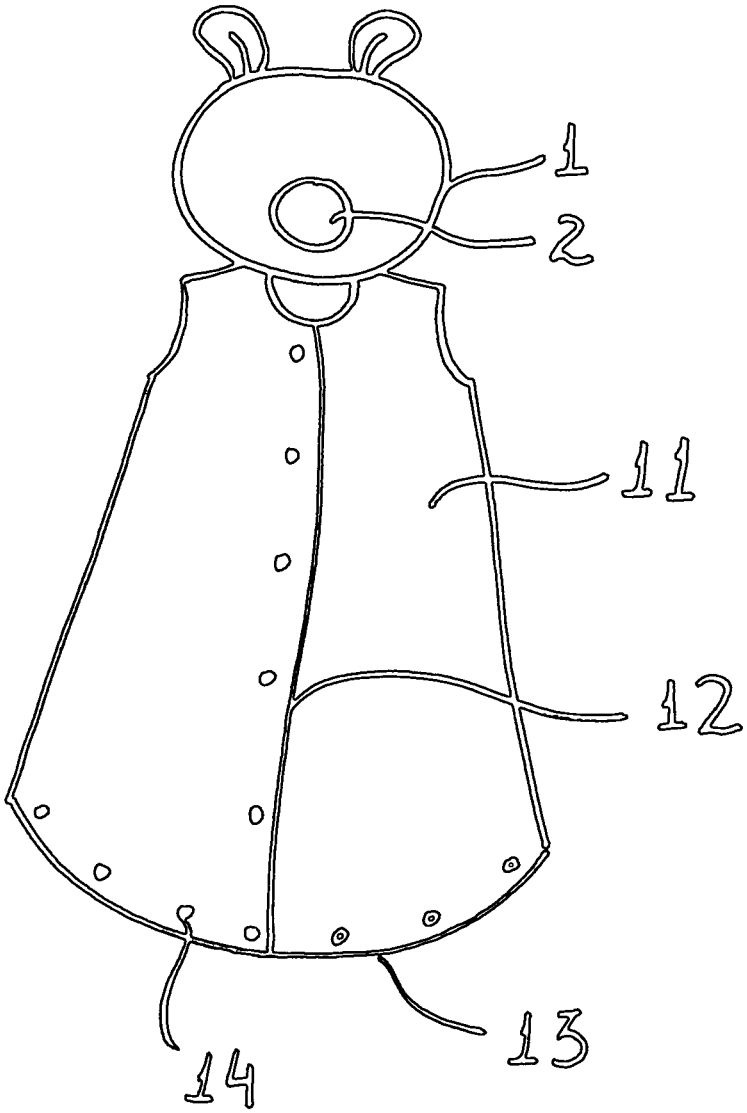
FIG. 2 would be helpful in an understanding of the invention in which the concave pillow is sewn to a wearable blanket.

In FIG. 2, a wearable blanket (11) is shown replacing the vest (5) of FIG. 1. The wearable blanket's front opening is shown as (12) and its bottom opening is shown as (13). Snaps for its closure are shown as (14). In FIGS. 1 and 2, it will be appreciated that the vest or wearable blanket attaches by sewing from the back of its collar to the lower edge of the concave pillow, near the neck area of the pillow. Moreover, the pillow (1) can have a circular, oval, square, rectangular or other symmetrical shape for its outer edge, as long as the area between its outer edge and the sewn circle (2) is filled, with the inside of the sewn circle remaining unfilled. To accomplish this, the sewn circle (2) can have the fabric of the inner unfilled area of the circle cut out from its manufacture, or not cut out, as the case may be. Where cut out, there will be no fill or fabric inside the sewn circle area. As will also be appreciated, the area surrounding the sewn circle (2) can be filled with different types of fill, including different types of polyester fiber, memory foam, or natural fibers. Although sewing the vest or wearable blanket to the collar is preferable, any alternative method of attachment can be employed, as by using fasteners. Those fasteners used for closure of the garment, as well as employed for attaching the garment to the collar, can include various types of fasteners—such as snaps, zippers, buttons, hook and loop arrangements, and/or ribbons preferably no longer than 6 inches.

In like manner, the concave pillow (1) sewn to the collar of the garment can be of a wide variety of fabrics—including different fabric fibers and different fabric textures, as well as including different fabric patterns and different fabric colors. Likewise, although vest and wearable blankets have been shown, other type garments are available—such as those with long sleeves, short sleeves or no sleeves at all, shirts, sweaters, jackets, body suits, overall body suits, jump suits, jumpers, robes, T-shirts, dresses and tops. In similar fashion, it will be appreciated that the pillow (1) can also attach to parts of the garment other than to its collar. For example, the pillow could attach lower towards the middle of the back of the garment, along with an optional fabric flap on the lower part or the neck area of the pillow, so as to connect the pillow and the garment together without changing the overall operation. And, as will be well appreciated, additional decorative changes can be made so that the combination of the concave pillow and garment allows for a construction to resemble animals, objects, plants, characters, themes and/or other shapes that will not alter their functions.

With the vest (5) as shown in FIG. 1—with fasteners on its front opening—, easy access can be had to the baby when dressing and undressing. Such vest will be seen to keep the infant comfortable in warmer temperatures since it does not cover the infant's arms or legs. With the wearable blanket of FIG. 2, on the other hand, front and bottom openings can be had with fasteners for closure. Such front opening will similarly allow for easy access to dress and undress the infant, while the bottom opening will allow better access for diapering of the infant. Such wearable blanket of FIG. 2 can have long, short or no sleeves depending upon where and when it is to be worn.

Figure 3:
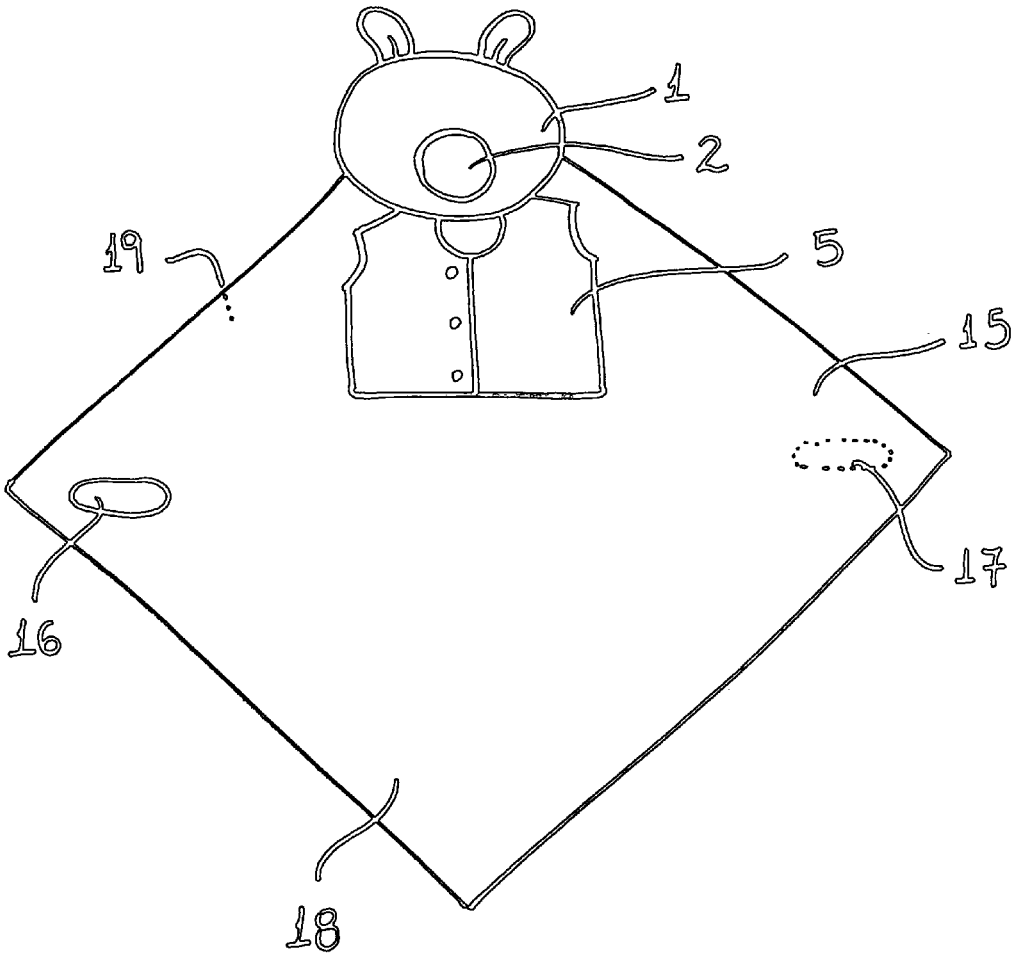
FIG. 3 would be helpful in an understanding of the invention in which the concave pillow is sewn to a swaddle blanket with a built in vest.
Figure 4:
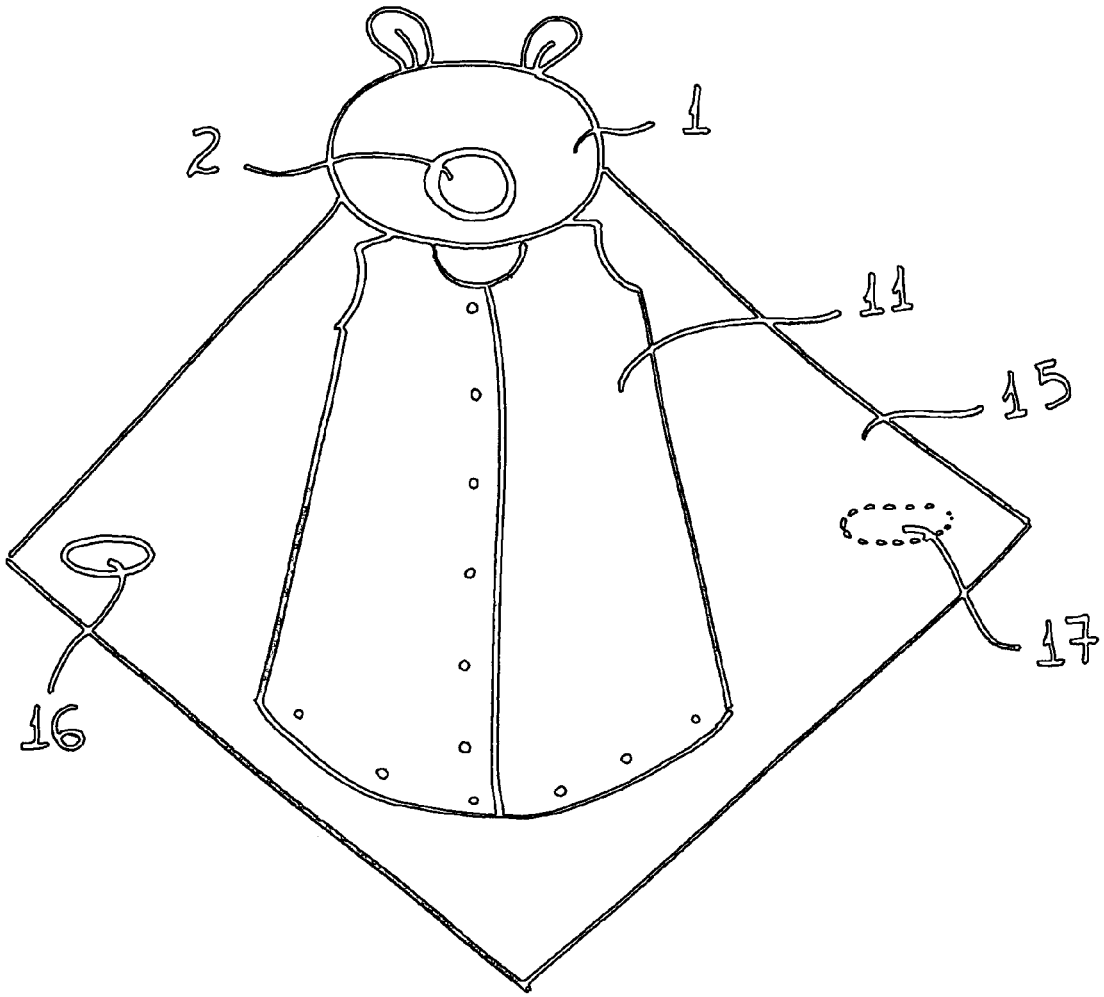
FIG. 4 would be helpful in an understanding of the invention in which the concave pillow is sewn to a swaddle blanket with a built in wearable blanket.

FIGS. 3 and 4 show that aspect of the invention in which the concave pillow (1) sewn to the collar of the vest or blanket garment attaches to a swaddle blanket (15) by direct sewing. As is well known, swaddling a baby is helpful in soothing its Startle, or Moro Reflex, which is very common in infants for the first few weeks of life. Such Startle Reflex is characterized by sudden movements of the infant during sleep or result from loud noises around the infant. With swaddling being helpful in keeping the infant warmer and more comfortable in colder temperatures, its use with the concave pillow-collar garment arrangement of the invention proves quite beneficial. As shown in FIGS. 3 and 4, the pillow-garment combination attaches to the swaddle blanket (15) near its uppermost corner in allowing for swaddling of the infant.

Fasteners (16) and (17) are strategically positioned on the swaddle blanket so as to be fastened to aid in keeping the swaddle blanket from opening and becoming loose around the infant while in use. The opening continues on the center top of the vest or wearable blanket garment in the nature of the hole through which the infant's neck and head extend, again with the two smaller holes on each upper side of the vest or wearable blanket through which the infant's arms extend. As with the pillow and vest or blanket garment, top and underside surfaces of the swaddle blanket are indicated as at (18), (19).

As with the FIGS. 1 and 2 configuration, the pillow (1) of FIGS. 3 and 4 can be provided with a circular, oval, square, rectangular or other symmetrical shape for its outer edge, with the area between the outer edge and the sewn circle (2) being filled, with the unfilled inside of the sewn circle within its center. The concave pillow sewn to the collar of the garment here, too, can have its sewn circle with the fabric of the inner unfilled area of the sewn circle cut out or not cut out—so that in a cut out sewn circle, there is no fill or fabric inside that area. As with the FIG. 1 and FIG. 2 arrangements, the area surrounding the sewn circle (2) can be filled with different types of fill, including different types of polyester fiber, memory foam or natural fibers. The swaddle blanket can be attached preferably by sewing to the combined concave pillow and vest or blanket garment, but can also be attached by using fasteners—likewise, the snaps, zippers, buttons, ribbons and/or hook and loop. The same variations of types of fabrics can be employed, as well as the types of garments which are sewn to the collar for wrapping within the swaddle blanket. The like decorative changes can be had in this configuration as well as the manner by which the pillow attaches to the back of the vest, wearable blanket or other garment to which the pillow connects.

Figure 5:
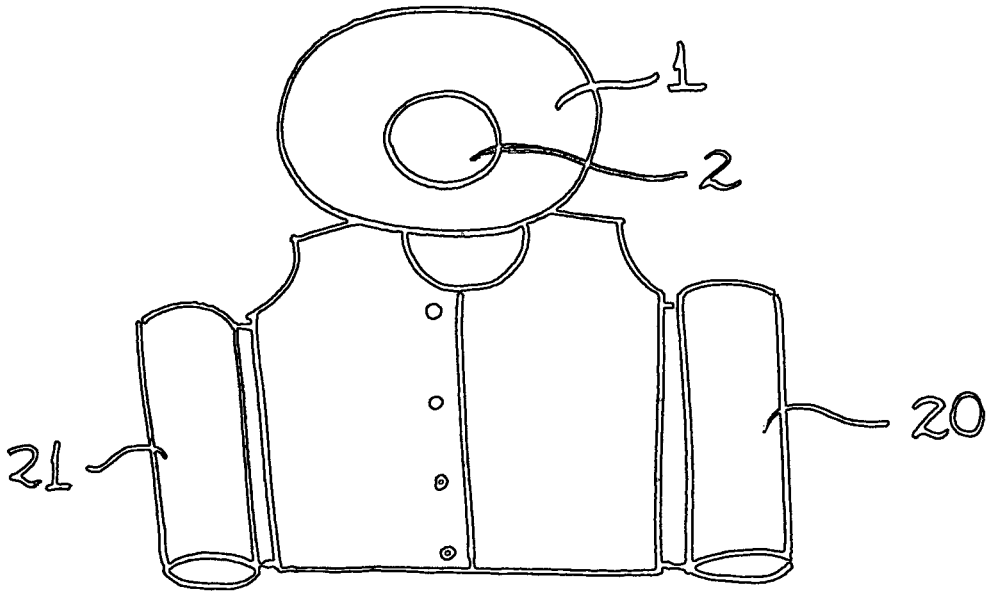
FIG. 5 will be helpful in an understanding of the invention in which the concave pillow is sewn to a vest, and utilizing side positioners to aid in keeping a child on its back.

That aspect of the invention shown in FIG. 5 proceeds by adding side positioners to the sides of the garment as a further aid in keeping the child on its back, restraining against rollover. Such side positioners can be sewn directly onto the garment at its edges, or attached by various fasteners in the manners previously described. These side positioners can be made in the nature of a hollow perforated cylinder, thinly padded, and covered with a highly breathable fabric, such as a mesh.

In FIG. 5, the pillow (1) is attached in the previous manner to a vest type garment (5) with side positioners shown as reference numeral (20) and (21)—in the nature of a hollow cylinder covered with a breathable fabric as a stabilizer, for example. As in the prior arrangements, whatever garment is sewn to the pillow can be worn with fasteners on its openings for closure, with an opening on the center top of the garment through which the infant's neck and head extend, with the smaller holes on each upper side of the garment through which the infant's arms extend and with top and bottom surfaces for the side cylinder shaped positioners.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the invention.

I claim:

1. A wearable garment or preventing Flat Head Syndrome in infants lying on their back comprising:

a wearable garment of a size to fit on and be worn by an infant, said garment having a collar;

said garment also having a concave pillow having upper, lower and side edges, a neck area, a circular area near its center, and a remainder outer area overlying said neck area, said remainder outer area being between said upper, lower and side edges surrounding said circular area;

a direct sewing from a back area of the garment to said lower edge of the pillow adjacent to said neck area of the pillow for forming the pillow integral with the garment;

an opening on a top portion of the wearable garment through which an infant's head extends when the garment is worn;

openings at opposite sides of the wearable garment through which the infant's arms extend when the garment is worn;

with said outer area of the pillow overlying said neck area of the pillow being composed of a supporting fill or fabric material; and with said circular area of the pillow being open or devoid of any supporting fill or fabric material;

whereby, with the garment being worn by the infant, said fill or fabric material overlying neck area of the concave pillow defines a location at which the neck of the infant is supported when lying on its back wearing the garment;

whereby, with the collar at a back area of the garment and the concave pillow being directly sewn together at the neck area of the pillow, the concave pillow remains toward the back of the infant's head when the infant attempts to roll over to its side or stomach while wearing the garment in being joined therewith; and whereby, with the circular area of the concave pillow being open or devoid of any supporting fill or fabric material, substantially no external pressure is exerted upwardly against the head of the infant lying on its back on a mattress or flat surface while wearing the garment.

2. The wearable garment of claim 1 wherein said outer area overlying said neck area of said pillow is composed of polyester fiber, memory foam, or natural fiber fill or fabric.

3. The wearable garment of claim 2 wherein said wearable garment includes one of a grouping of garments with long, short or no sleeves, of vests, shirts, wearable blankets, sweaters, jackets, body suit, jump suits, jumpers, robes, T-shirts, dresses and tops.

4. The wearable garment of claim 3, also including means for manually opening and closing the garment when worn.

5. The wearable garment of claim 1, also including a restraint to keep against infant attempts to roll over in keeping the infant lying on its back, said restraint including a pair of side positioners sewn on said opposite sides of the wearable garment and extending outwardly therefrom.

6. The wearable garment of claim 5 wherein said pair of side positioners include pairs of hollow cylinders covered with breathable fabric.

7. The wearable garment of claim 1 wherein said circular area of the concave pillow is positioned substantially midway between the side edges of the pillow and closer to the lower edge of the pillow than to the top edge of the pillow.

8. A wearable garment for preventing both Sudden Infant Death Syndrome and FlatHead Syndrome in infants, comprising:

a wearable garment of a size to fit on and be worn by an infant, said garment having a collar;

said garment also having a concave pillow having upper, lower and side edges, a neck area, a circular area near its center, and a remainder outer area overlying said neck area, said remainder outer area being between said upper, lower and side edges surrounding said circular area;

a direct sewing from a back area of the garment to said lower edge of the pillow adjacent to said neck area of the pillow for forming the pillow integral with the garment;

an opening on a top portion of the wearable garment through which an infant's head extends when the garment is worn;

openings at opposite sides of the wearable garment through which the infant's arms extend when the garment is worn;

with said outer area of the pillow overlying said neck area of the pillow being composed of a supporting fill or fabric material; and with said circular area of the pillow being open or devoid of any supporting fill or fabric material;

whereby, with the garment being worn by the infant, said fill or fabric material overlying neck area of the concave pillow defines a location at which the neck of the infant is supported when lying on its back wearing the garment;

whereby, with the collar at a back area of the garment and the concave pillow being directly sewn together at the neck area of the pillow, the concave pillow remains toward the back of the infant's head when the infant attempts to roll over to its side or stomach while wearing the garment in being joined therewith;

whereby, with the circular area of the concave pillow being open or devoid of any supporting fill or fabric material, substantially no external pressure is exerted upwardly against the head of the infant lying on its back on a mattress or flat surface while wearing the garment;

also including a restraint against infant attempts to roll over in keeping the infant lying on its back, said restraint including a pair of side positioners sewn on said opposite sides of the wearable garment and extending outwardly therefrom; and wherein said wearable garment includes one of a grouping of garments with long, short or no sleeves, of vests, shirts, wearable blankets, sweaters, jackets, body suit, jump suits, jumpers, robes, T-shirts, dresses and tops.

9. The wearable garment of claim 8 wherein said pair of side positioners include pairs of hollow cylinders covered with breathable fabric.

10. The wearable garment of claim 9, also including means for manually opening and closing the garment when worn.

* * * * *